United States Patent [19]

Marlow

[11] Patent Number: 4,673,828

[45] Date of Patent: Jun. 16, 1987

[54] COIN OPERATED SWITCH

[75] Inventor: John Marlow, N. Charleston, S.C.

[73] Assignee: Holliday Amusement Company, Inc. of Charleston, Charleston, S.C.

[21] Appl. No.: 721,277

[22] Filed: Apr. 8, 1985

[51] Int. Cl.[4] ..... H01H 47/32; G07F 11/00

[52] U.S. Cl. ..... 307/139; 307/113; 194/220; 194/222; 200/DIG. 3

[58] Field of Search ..... 307/38, 139, 113; 194/9 R, 5, 10, 11, 13, 9 T, 222, 215, 219, 220; 200/DIG. 3, 27 B, 39 A, 38 D, 38 DA; 361/154, 155, 156, 157, 168.1, 180, 181, 187, 190, 194, 195, 196, 197, 199, 202

[56] References Cited

U.S. PATENT DOCUMENTS

| | | | |
|---|---|---|---|
| 2,718,613 | 9/1955 | Harris | 361/194 |
| 2,980,826 | 4/1961 | Horton | 361/196 |
| 2,990,930 | 7/1961 | Melvin | 194/9 R |
| 2,995,230 | 8/1961 | Moody et al. | 194/9 |
| 3,098,953 | 7/1963 | Herr | 361/197 |
| 3,116,370 | 12/1963 | Andregg et al. | 194/9 R X |
| 3,144,568 | 8/1964 | Silliman et al. | 361/197 X |
| 3,226,567 | 12/1965 | Bradmiller et al. | 361/195 X |
| 3,310,144 | 3/1967 | Sandhoff | 194/13 |
| 3,344,898 | 10/1967 | Klinikowski | 194/9 R |
| 3,440,451 | 4/1969 | Honig | 361/196 X |
| 3,460,661 | 8/1969 | Albright et al. | 194/9 R |
| 3,491,871 | 1/1970 | Bauer | 194/10 |
| 3,509,535 | 4/1970 | Berube | 194/206 X |
| 3,521,733 | 7/1970 | Shirley | 194/9 R |
| 3,540,562 | 11/1970 | Ptacek | 194/10 |
| 3,671,816 | 6/1972 | Ritzow | 361/197 X |
| 3,723,829 | 3/1973 | Schartmann | 361/196 |
| 3,740,568 | 6/1973 | Ikeda | 307/139 X |
| 3,783,987 | 1/1974 | Hanert et al. | 194/10 |
| 3,844,394 | 10/1974 | Hale et al. | 194/10 |
| 3,880,268 | 4/1975 | Burzen | 194/230 |
| 4,493,410 | 1/1985 | Nelson | 194/9 T |

*Primary Examiner*—William M. Shoop, Jr.
*Assistant Examiner*—Shik Luen Paul Ip
*Attorney, Agent, or Firm*—B. C. Killough

[57] ABSTRACT

This invention is a coin operated switch which may be incorporated into coin operated machines such as video games to reduce cheating of the credit granting feature of the machines. This invention incorporates two electromechanical switches and circuitry which further use the existing machine circuitry to time the travel of a coin between the switches and to grant a credit on the machine only if each switch is tripped and released in the proper order and within the predetermined elapsed time.

5 Claims, 2 Drawing Figures

COIN OPERATED SWITCH

BACKGROUND OF THE INVENTION

This invention relates generally to coin operated or actuated devices, and relates more particularly to an actuator or switch to reduce or eliminate the cheating of coin operated devices.

Coin operated machines and devices are in widespread use, and include vending machines, amusement devices, and devices which provide services such as car washes. The user of these machines drops the appropriate number and combination of coins into the machine, with the machine responding by dispensing the product or service which the customer has selected. The very nature of these machines means that they are rarely watched or supervised, leading to the very serious problem of cheating the machines. One common method of cheating the machines is by tripping the credit or actuator switch on these machines by means other than the coins which the machine is designed to accept.

Electronic amusement games have been particularly subject to abuse by users attempting to obtain credits on the machine by means other than the insertion of coins. These machines are actuated generally by dropping a coin or coins into a slot on the front of the machine. The coin falls through a series of channels which are designed by shape and route to determine whether the object is actually the coin which the machine is designed to accept. If there is a discrepancy in the size, weight or composition of the device which is dropped into the slot, the object is eliminated from the system, and is not allowed to pass through the actuator switch. If a coin has been dropped into the slot, it is allowed to pass completely through the route and through an actuator switch. In most amusement machines commonly in use, the coin trips an electromechanical switch which causes a circuit to be grounded, giving the user a credit on the machine. The coin operated amusement device may then be played by the user.

The coin operated amusement machines which are presently and commonly in use comprise one electromechanical credit switch, which receives the coin after it has passed through the series of channels to eliminate flat, circular objects which are not coins ("slugs"). Persons who wish to cheat these machines have learned that by inserting a stiff wire or other foreign object into the slot on the front of the machine the switch may be tripped, causing the machine to grant a credit without a coin being inserted. These machines commonly incorporate a timing circuit which prevents the granting of a credit unless the switch is tripped and released within a preset elapsed time, however, a skilled cheater can use a wire to trip the switch within the allowed time. This common problem results in the owner and/or operator of the coin operated amusement device being cheated and deprived of receipts.

A particular method of cheating a machine is known as "stringing". A hole is drilled or punched in a coin and a thin string or line is attached to the coin through the hole. The coin is then lowered into the coin slot while holding the string until a credit is granted. The string is then pulled up slightly and dropped again, granting credits as desired by means of the "strung" coin.

SUMMARY OF THE INVENTION

The present invention provides a device which will drastically reduce or eliminate the cheating of coin operated devices, and particularly coin operated amusement devices, by the insertion of foreign objects and tripping of the switch. The present invention replaces the single electromechanical switch with a series of two switches (FIG. 1), and further incorporates a circuit which times the travel of the coin through the series of switches. Only if the coin travels by gravity through the series of switches within a predetermined time will the device cause the machine to grant a credit to the user. Persons attempting to cheat the machine cannot insert a wire or other foreign object into the machine and trip and release both switches in the succession and time allowed. The device takes very little more space than the single switch presently used on most coin operated amusement devices and can be readily and quickly installed in the space available. Further, the device actuates credits by the grounding of the machine's circuit, and no modifications of the machine's existing circuitry are necessary for the vast majority of coin operated amusement machines presently in use.

DETAILED DESCRIPTION OF THE DRAWINGS

DETAILED DESCRIPTION OF THE PREFERRED EMBODIMENT

Figure 1:
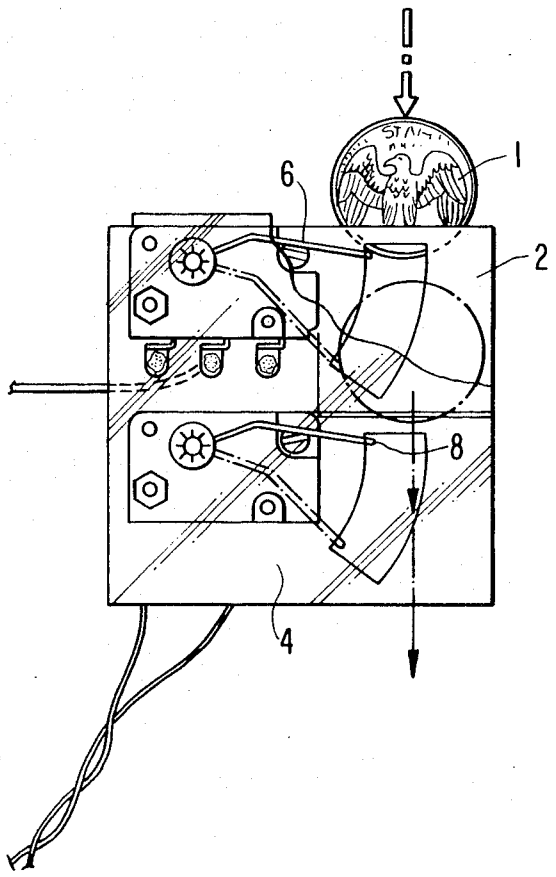
FIG. 1 is an action view of the mechanical operation of the device as the coin falls through the switches.

As shown in FIG. 1, the device receives a coin 1 (such as a U.S. quarter dollar), which falls by gravity into and through the first switch 2. As the coin 1 falls through the first switch 2, it displaces a trip wire 6 as shown. After the coin has passed the trip wire 6, the trip wire 6 returns to its original (normal) position.

Located in physical series with the first switch 2 is a second switch 4 identical to the first. As the coin leaves switch 2 it immediately enters switch 4, again displacing a trip wire 8. The coin then falls out of switch and into a coin collection box and trip wire 8 returns to its normal position.

Switch 2 and switch 4 are microswitches of the type presently and commonly in use in such machines, and are commercially available. The coin enters switch 2 after traveling through a channel designed to ascertain that the size, weight and composition of the object traveling through the channel indicate that it is in fact the type of coin which the machine is designed to accept. In coin operated amusement machines commonly in use today, only one switch is used, with the switch causing a circuit to ground as the trip wire is displaced, and granting a credit on the machine if the trip wire returns to its normal position within a predetermined time. After the coin falls through and out of the switch, it is collected as described above.

The present invention provides for timing the fall of the coin through the switches 2 and 4, and causing the machine to grant a credit only if the switches are tripped and released in the proper succession and within a given time.

Figure 2:
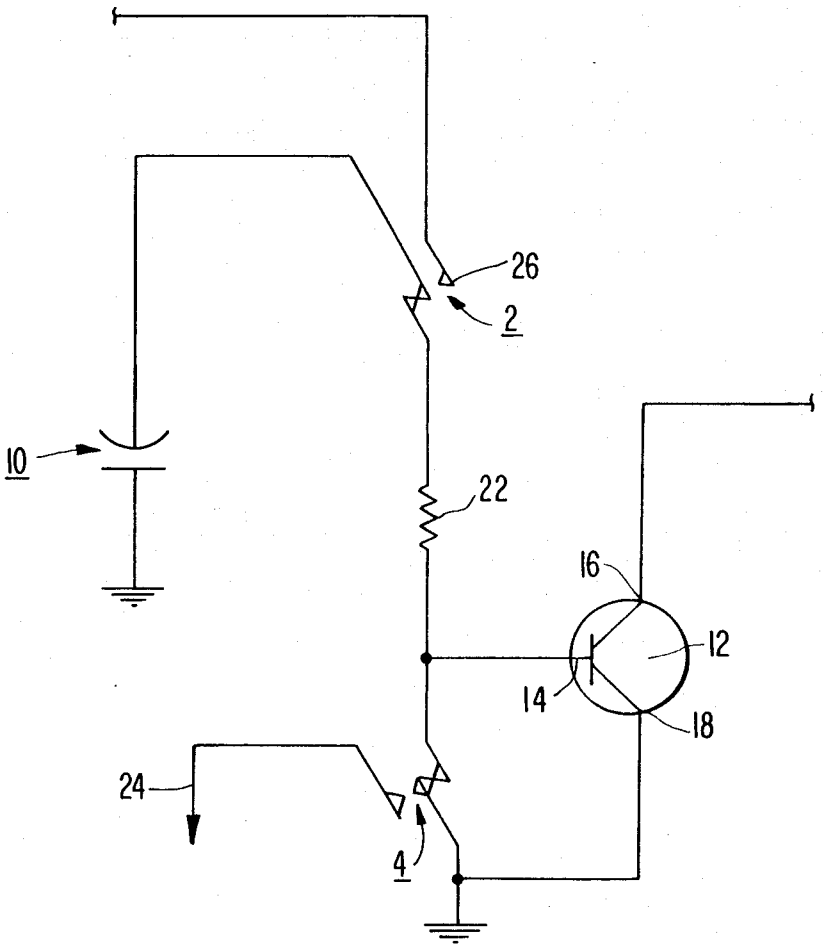
FIG. 2 is a schematic diagram of the circuitry of the device.

In the preferred embodiment, this timing is accomplished via the circuit shown in FIG. 2. When switch 2 is tripped, it causes capacitor 10 to charge. When switch 2 is released and returns to the normal position, capacitor 10 begins to discharge. As capacitor 10 discharges, the base 14 of transistor 12 receives the charge.

The ground or credit circuit 20 from the machine is connected to the collector 16 of transistor, and the emmiter 18 is grounded. If switch 2 has been actuated so as to cause capacitor 10 to charge, and is subsequently released, the credit circuit 20 will be grounded upon actuation of the switch 4 due to a charge being present on the base 14 of the transistor 12.

If switch 2 is not actuated and released prior to switch 4 being actuated, no charge will be present on the base 14 of the transistor 12, and the credit circuit 20 will not ground, and accordingly, no credit will be granted by the machine. A resistor 22 is used between the capacitor 10 and the base 14 of the transistor 12 to regulate the discharge rate of the capacitor 10 according to the travel time of the coin 1, to insure that the capacitor 10 does not discharge prior to switch 4 being actuated when a proper coin is inserted and falls through the switches.

As switch 2 goes to the normally open position 26 upon the coin falling through, and the transistor base 14 receives a positive charge from capacitor 10, the credit circuit 20 grounds through the collector 16 and emitter 18 of the transistor crediting the user. If switch 2 is not actuated and released, or if it is actuated and released more than a predetermined time before switch 4 is actuated, then no credit is granted. The device if further aided by the circuitry existing on most coin operated amusement devices, since holding down of the trip wire for more than a predetermined time, usually 0.25 seconds, creates an error situation in the machine's circuitry, and no credit is given. Likewise, actuation of switch 4 without release for more than the predetermined time creates on error situation through the machine's existing circuitry.

The invention then requires that a coin fall through the first switch, and that this switch be released for a predetermined time prior to the coin actuating the second switch for the credit circuit to be grounded. The time between actuation and release of the first switch and actuation of the second switch may be determined by the particular devices which are used. Factors such as the physical proximity of the two switches will be determinitive of the particular devices to be used. Using the type of switches which are commonly used by major manufacturers of such coin operated devices, and locating the switches in the closest physical proximity possible, the following are preferred values for the devices:

CAPACITOR: 22 microfarad
RESISTOR: 10 kilo ohm
TRANSISTOR: 2N2222

The capacitor would normally be charged with 5 volts of direct current upon actuation of switch 2. It has been found that a capacitor having a range of 22 to 100 microfarads is workable in most applications, with the resistor ranging from 470 ohms to 10 kiloohms. A potentiometer or variable register may be used.

By minor variations, the device can be adapted to many types of coin operated devices. When used in conjunction with the series of channels which rejects "slugs", the device will drastically reduce the cheating of coin operated machines which frequently occurs. Further accountability may be had by connecting the circuit 24 to a counter, which will count the number of times the device is actuated. A battery or battery pack may be used to supply the direct current to the device for those machines having counters which reset when the external A.C. source is removed.

What is claimed is:

1. A theft retarding coin operated actuator for use with coin operated machines which grant credits by grounding a circuit, comprising:

a. a first switch means which is actuated in response to a coin passing through said switch means and which returns to a normal position after said coin has passed through said switch means;

b. a capacitor which is charged upon actuation of said first said means, and which discharged upon the return of said first switch means;

c. a transistor having a base, a collector, and an emitter, with the base being capable of receiving said charge from said capacitor as said capacitor discharges, with the collector being connected to a credit circuit from said coin operated machine, and said emitter being connected to a ground;

d. a resistor which regulates the rate of discharge of said capacitor; and e. a second switch means which receives said coin subsequent to said first switch means and which is actuated in response to said coin passing through said control means and which returns to its normal position after said coin has passed, allowing said charge from said capacitor to charge said base of said transistor and cause said credit circuit to ground through said collector and emitter if said second switch means is actuated during the discharge of said capacitor, and which causes said charge to be grounded if said second switch means is not actuated during said discharge of said capacitor, preventing said credit circuit from grounding through said transistor.

2. A coin operated actuator as described in claim 1, wherein said capacitor is a 22 to 100 microfarad capacitor which receives 4 to 6 volts upon actuation of said first switch, and wherein said resistor is a 470 ohm to 10 kilo ohm resistor.

3. A coin operated actuator as described in claim 2, wherein said transistor is a 2N2222 transistor.

4. A coin operated actuator as described in claim 1, wherein said transistor is a 2N2222 transistor.

5. A coin operated actuator as described in claim 3, wherein said capacitor further comprising a meter connected to said second switch so as to count the number of times said switch is actuated.

* * * * *